United States Patent [19]

Kellis et al.

[11] Patent Number: 4,669,238

[45] Date of Patent: Jun. 2, 1987

[54] PLASTIC SIDING MOUNTING SYSTEM

[75] Inventors: Warren D. Kellis, Troy; Daniel King; Lyle Rice, both of Jackson, all of Mich.

[73] Assignee: Wolverine Technologies, Inc., Lincoln Park, Mich.

[21] Appl. No.: 842,324

[22] Filed: Mar. 21, 1986

[51] Int. Cl.[4] ..... E04B 1/00

[52] U.S. Cl. ..... 52/105; 52/521

[58] Field of Search ..... 52/105, 573, 278, 409, 52/478, 520, 528, 524–531, 543, 546, 550, 556; 29/515, 521

[56] References Cited

U.S. PATENT DOCUMENTS

| | | | |
|---|---|---|---|
| 1,601,735 | 10/1926 | Harris | 52/532 |
| 1,968,217 | 7/1934 | Moffit | 52/546 |
| 2,820,535 | 1/1958 | Hutchison | 52/520 |
| 3,214,876 | 11/1965 | Mattes | 52/520 |
| 3,226,901 | 1/1966 | Harter | 52/530 |
| 3,520,099 | 7/1970 | Mattes | 52/521 |
| 3,552,078 | 1/1971 | Mattes | 52/531 |
| 3,703,795 | 11/1972 | Mattes | 52/521 |
| 3,982,373 | 9/1976 | Wilson et al. | 52/528 |

*Primary Examiner*—James L. Ridgill, Jr.

*Attorney, Agent, or Firm*—Cullen, Sloman, Cantor, Grauer, Scott & Rutherford

[57] ABSTRACT

A mounting system for plastic siding comprises an elongated nailing strip from which a siding panel is suspended by means of interlocking channels which permit longitudinal relative movement resulting from differential thermal expansion or contraction. A predetermined amount of horizontal overlap of adjacent panels is assured by the provision of a notch adjacent each end of the panel, which notch is intended to be vertically aligned with the end of the adjacent panel. The same notches provide a guide for centering the nailing strip on its associated panel. Unintended disassembly of each strip-panel pair is presented by dimple-like deformations near the end of each strip cahnnel, which function to limit the longitudinal travel of the associated panel channel therein.

5 Claims, 4 Drawing Figures

PLASTIC SIDING MOUNTING SYSTEM

BACKGROUND OF INVENTION

In the field of horizontally disposed metal or plastic siding panels for building exteriors, a variety of mounting means have been utilized to secure the panels to the underlying wall structure. In some cases, the panels themselves have been directly nailed or stapled to the underlying structure. In other cases, the panels have been interlocked and suspended from short clips or long nailing strips which are in turn nailed or otherwise secured to the underlying building structure. Representative showings of these interlocking and securing arrangements are found in U.S. Pat. Nos. 2,820,535, 3,214,876, 3,520,099, 3,552,078 and 3,703,795.

The prior art recognized the need to permit relative longitudinal movement between the suspended siding panel and any nailing clip or strip from which it was suspended. This requirement results from differential thermal expansion and contraction between the siding panel and the nailing clip or strip. Differing expansion and contraction of these materials is caused by several factors. First, the panels may be directly exposed to substantial temperature fluctuations and direct solar heating, while the nailing clips or strips are located behind such panels and therefore are not exposed to direct solar heating. Secondly, the panels and nailing clips or strips may be formed of different materials. For example, the nailing clips or strips are generally fabricated of aluminum or steel, while the siding panels may be fabricated of vinyl, aluminum, steel or other plastic or metal materials. The necessary relative movement has generally been provided by interlocking horizontally extending tracks or channels which permit the panel to hang from the nailing strip or clip, while permitting longitudinal sliding of the panel.

However, the thermal expansion and contraction phenomenon also creates a problem in terms of the extent of horizontal overlap between the longitudinal ends of adjacent panels. If the extent of overlap is initially too small, then subsequent contraction of both panels during colder weather may eliminate the overlap, creating an unsightly exposure of the underlying structure. Conversely, if the overlap is initially too great, subsequent thermal expansion may cause the underlying nailing strips or siding panels to establish an interfering abutting relationship, causing bulging or buckling of these components. The abutment of overlapped panels occurs, not at the visible longitudinal ends of the panels, but more typically at the interlocking flange formations. That is, the formations at the upper or lower longitudinal edges of each panel, where the panels interlock with upwardly or downwardly adjacent panels or nailing strips or clips, generally do not run the full longitudinal lengths of the siding panel. They terminate before the extreme longitudinal end of the panel to permit horizontally adjacent panels to overlap each other without interference by these formations. Therefore, horizontally adjacent panels which are installed in overlapping relationship at their longitudinal ends are free to lengthen without interference with each other, but only until those interlocking formations abut each other.

Another problem or inconvenience that arises with the use of elongated nailing strips is that the strips are not sufficiently stiff to survive rough handling during packing, unpacking or assembly. If they are bent, a resulting permanent crease or kink can restrict the cross-sectional openings that exist between the flange or channel formations that are designed to interlock with those on the siding panels. The result of such kinking is interference with the assembly of a panel-nailing strip pair. This problem is aggravated by the fact that a typical panel may be twelve feet long, and therefore the handling of these long, readily-bendable nailing strips as they are unpacked from a box and slidably assembled along the length of a siding panel creates a high risk of damage.

Accordingly, it would be desirable to provide a means for permitting factory pre-assembly of each nailing strip-siding panel pair, and in a manner that, while permitting subsequent relative slidable movement to accommodate thermal expansion contraction, prevents the panel from becoming disassembled from the nailing strip during handling prior to installation.

SUMMARY OF THE INVENTION

According to the present invention, a notch or other formation is provided adjacent each end of a siding panel strip. Such notch is spaced from the end by a distance corresponding to the desired initial overlap between horizontally adjacent siding panels. In this manner, the siding installer has a readily visible gauge to guide him, whereby he overlaps a panel being installed over the end of a horizontally adjacent panel until the end of one panel is directly vertically aligned with the notch adjacent the end of the other panel.

To avoid the problem of thermal growth of the nailing strips causing the nailing strips to abut each other, the nailing strips are preferably made shorter than their associated panel. The same notches described above also assist the installer in centering the nailing strip on the panel during the installation process, thereby avoiding the placement of adjacent nailing strips too closely together.

Finally, to prevent the panel and nailing strip from becoming disassembled during handling, a crimp or dimple is formed in the nailing strip track or flange formation through which the siding panel slides, following assembly at the factory. Such local deformation is placed immediately adjacent each end of the nailing strip so that it normally does not interfere with the relative longitudinal movement between the nailing strip and panel that results from thermal expansion and contraction. Such relative movement is permitted because the deformation aligns with the portion of the associated siding panel where the interlocking formations of the siding panel are discontinued adjacent the end of the panel. Therefore, the deformation is not engaged by the panel during normal thermal growth. During handling, however, extensive relative longitudinal movement is prevented by the deformation engaging the end of the interlocking formations on the panel.

DETAILED DESCRIPTION OF THE INVENTION

Figure 1:
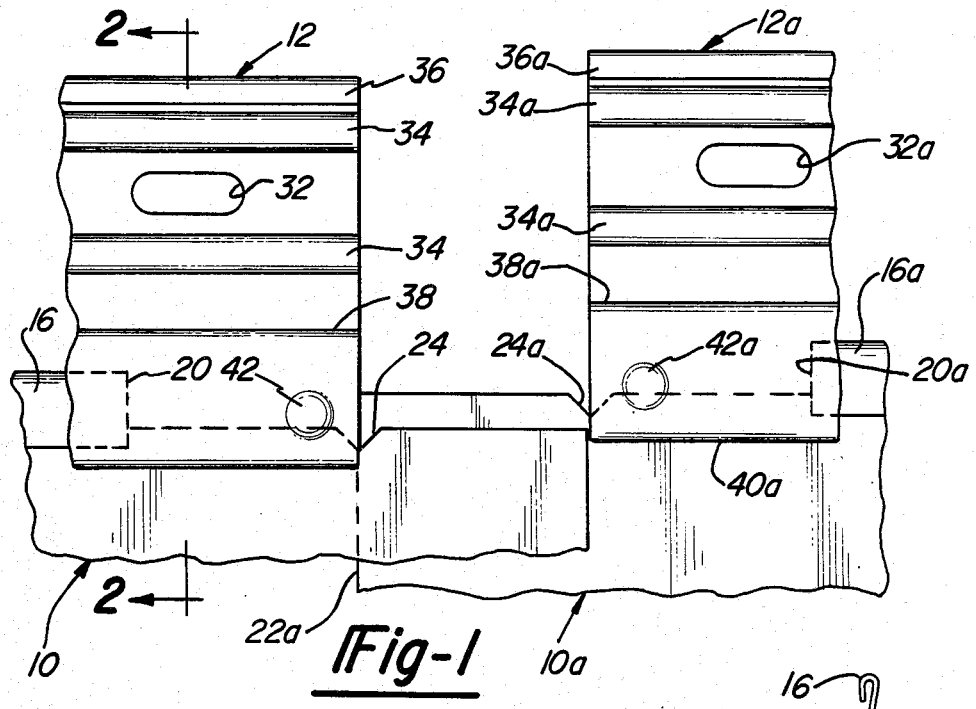
FIG. 1 is a fragmentary front view of the overlapped portion of two adjacent siding panels and their associated nailing strips, looking from the exterior of the wall toward the wall.

In the drawings and following description, corresponding parts of adjacent nailing strips and of adjacent siding panels carry the same reference numeral, but with the right-hand panel-strip set carrying the suffix letter "a".

Figure 3:
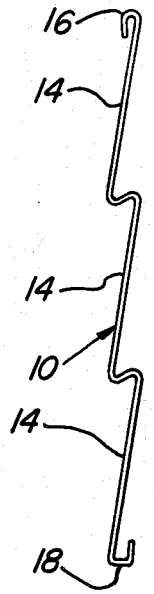
FIG. 3 is an end view, on a smaller scale, of one complete siding panel.

The system generally consists of a siding panel 10 and an elongated nail strip or "hem" 12. As best shown in FIG. 3, each siding panel 10 comprises three parallel inclined portions or faces 14, intended to simulate three vertically adjacent and overlapping course of conventional wood siding. Panel 10 is preferably formed of thin-walled vinyl, in conventional fashion, in lengths which may typically be about 12 feet and widths which may be about 9 inches. However, it is to be understood that the present invention may also be applied to siding panels formed of other plastic materials or metal, and in other lengths and widths. Nail hem 12 is preferably formed of aluminum, but could also be formed of steel or fiber-reinforced plastic. In a preferred embodiment, the nailing strip may be about one and one-quarter inches high and formed of stock which is approximately 0.021–0.025 inches in thickness.

Figure 2:
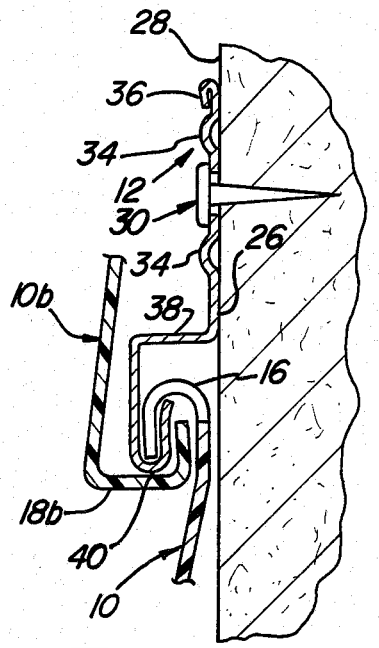
FIG. 2 is a cross-sectional view in the direction of arrows 2—2 of FIG. 1, but additionally showing the lower portion of an upwardly adjacent siding panel.
Figure 4:
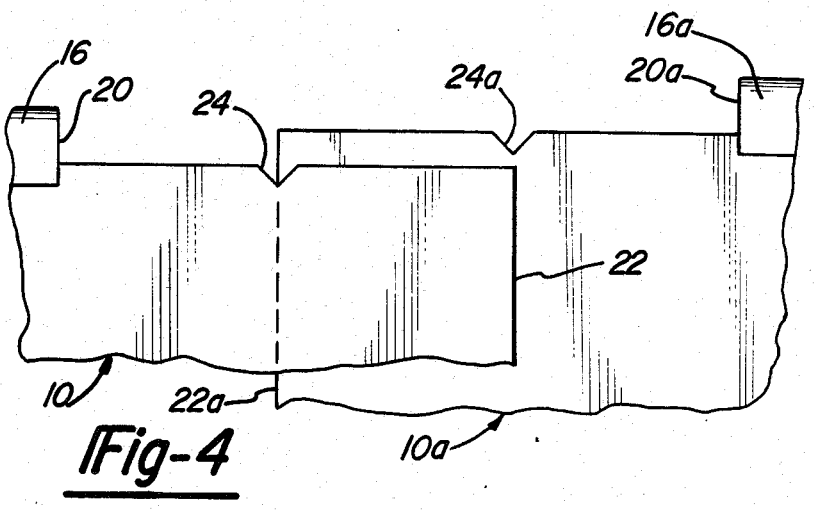
FIG. 4 is a fragmentary view similar to FIG. 1, but omitting the nailing strips for clarity.

Referring particularly to FIG. 2, each siding panel 10 comprises an upper inverted U-shaped channel 16 and a lower U-shaped channel 18. As seen in FIGS. 1 and 4, each upper channel terminates at an end 20 which is spaced from the panel end 22 by a distance which may be about one and one-half inches. Each longitudinal end of panel 10 is provided with a notch 24, which, in an exemplary embodiment, is spaced about three-fourths of an inch from panel end 22.

Referring now to the nail hem 12, illustrated in FIGS. 1 and 2, each hem comprises a generally planar mounting surface 26 adapted to abut face 28 of the underlying wall structure. The underlying wall may conventionally be formed of such materials as wood, pressed board or insulating foam board, in turn nailed or stapled to wooden studs. Nail hem 12 is secured to the wall structure by nails 30 which are inserted through longitudinally spaced nail slots 32. Above and below the row of nail slots is a pair of stiffening beads or ridges 34, and the upper edge of nail hem 12 is doubled over at 36 to provide additional stiffening.

Nail hem 12 is also provided with an upwardly projecting shoulder 38 which permits lower U-shaped channel 40 to be spaced outwardly from wall surface 28 a sufficient distance to permit the interlocking assembly with the associated siding panels 10.

As shown in FIG. 1, a dimple or crimp 42 is placed in the lower flange 40 at each end of nail hem 12 to inwardly deform the front and rear legs of such channel sufficiently to prevent passage of upper channel 16 of the siding panel therethrough. Such deformation prevents the hem from sliding off the panel during handling so that the installer need not be concerned about assembling these components on the building site.

The method of overlapping horizontally adjacent panels at the time of application to a building wall will now be described. For purposes of explanation, assume that panel 10*a* and nail hem 12*a* have previously been secured to building wall. Panel 10*a* should be centered on its associated nail hem 12*a* by vertically aligning notch 24*a* with the edge of hem 12*a*, as shown in FIG. 1. As can be seen in FIG. 1, panel 10*a* is free to thermally expand relative to hem 12*a* until its upper channel end 20*a* reaches dimple 42*a*. Until that time, as can be seen in FIG. 2, channel 16 can freely slide longitudinally in channel 40 of the nail hem from which it is suspended.

Next, panel 10 and its pre-assembled nail hem 12 is brought into horizontal alignment with panel 10*a*. Specifically, bottom channel 18 is first slid upwardly into the gap formed between hem channel 40 and channel 16 of the next lower course panel. In FIG. 2, the bottom channel 18*b* of the next upper panel 10*b* is shown as it interfits in this manner. That establishes the approximate location of panel 10 on the wall. It is then slid laterally or horizontally untl its end 22 aligns with notch 24*a* of horizontally adjacent panel 10*a*, as shown in FIGS. 1 and 2. The step establishes the proper amount of horizontal overlap between adjacent panels 10 and 10*a*. In the preferred embodiment, the overlap is about three-fourths of an inch.

Next, nail hem 12 is centered on siding panel 10 by aligning the end of hem 12 with notch 24, as shown in FIG. 1. This step provides the desired three-fourths of an inch gap between adjacent hems 12 and 12*a*.

Finally, hem 12 is secured to the underlying wall structure by means of nails 30 or staples, as desired.

This invention may be further developed within the scope of the following claims. Accordingly, the above specification to be interpreted as illustrative of only a single operative embodiment of this invention, rather than in a strictly limited sense.

We now claim:

1. In a mounting system for building siding of the type wherein a panel of horizontally elongated thin-walled siding is adapted to be suspended from a horizontally disposed and elongated attachment strip by means of interlocking channel formations on the upper portion of the panel and on its associated attachment strip when the attachment strip is secured to an underlying wall structure, and wherein the panel is longitudinally slidable relative to the strip following installation to permit the panel and strip to thermally lengthen or shorten relative to each other as a result of their different coefficients of thermal expansion when exposed to changing ambient conditions, the lower edge of each panel overlying and interlocking with the interlocking channel formations of the next vertically adjacent lower panel course and attachment strip, the improved means for establishing the proper horizontal overlap of horizontally adjacent panels at the time of installation which comprises:

each of said panels being fabricated with a panel overlap mark on the upper portion of said panel and spaced from a longitudinal end of said panel by a predetermined distance equal to the preferred length of overlap, said mark being located so that it will be obscured from view by said overlying lower edge of the next vertically adjacent course of the panels following installation thereof;

whereby said panels may be accurately positioned at installation by longitudinally overlapping a first panel over a previously secured horizontally adjacent second panel to an extent such that said overlap mark on one of said first and second panels is in substantial vertical alignment with the longitudinal end of the other of said first and second panels.

2. The mounting system of claim 1 wherein said overlap mark on said panel also serves as a guide to establish the longitudinal position of said panel on the attachment strip from which said panel is suspended at the time said strip is secured to the underlying wall surface by aligning said mark with the longitudinal end of the associated attachment strip, thereby assuring that longitudinally adjacent attachment strips are properly spaced from each other at the time of installation to prevent interfering contact with each other after subsequent thermal expansion.

3. The mounting system of claim 1 wherein the channel on said attachment strip from which a cooperating panel is suspended is deformed following sub-assembly of a cooperating strip-panel pair, said deformation being located at a point near a longitudinal end of said strip and normally spaced beyond the end of the cooperating channel on said panel, whereby said panel end is prevented from sliding beyond said deformation in said strip channel while still being capable of relative sliding movement to accommodate differential thermal expansion or contraction.

4. The mounting system of claim 1 wherein both longitudinal ends of each panel are provided with one of said overlap marks.

5. The mounting system of claim 3 wherein both longitudinal ends of said strip are deformed to limit movement of said panel thereon in both longitudinal directions, thereby preventing unintentional disassembly of said strip-panel pair during shipment and pre-installation handling thereof.

* * * * *